US010920459B2

(12) United States Patent
Malone

(10) Patent No.: US 10,920,459 B2
(45) Date of Patent: Feb. 16, 2021

(54) MULTI-LOCK HANDCUFFS

(71) Applicant: John Malone, Spring Grove, PA (US)

(72) Inventor: John Malone, Spring Grove, PA (US)

( * ) Notice: Subject to any disclaimer, the term of this patent is extended or adjusted under 35 U.S.C. 154(b) by 224 days.

(21) Appl. No.: 16/229,923

(22) Filed: Dec. 21, 2018

(65) Prior Publication Data

US 2019/0194981 A1 Jun. 27, 2019

Related U.S. Application Data

(60) Provisional application No. 62/609,690, filed on Dec. 22, 2017.

(51) Int. Cl.
*E05B 75/00* (2006.01)

(52) U.S. Cl.
CPC ..... *E05B 75/00* (2013.01)

(58) Field of Classification Search
CPC ..... E05B 75/00
USPC ..... 70/14–19; 24/16 PB; 119/816, 819; 128/878, 879
See application file for complete search history.

(56) References Cited

U.S. PATENT DOCUMENTS 1,775,727 A * 9/1930 Latou ..... E05B 75/00 70/16
1,845,511 A * 2/1932 Neal ..... E05B 75/00 70/16
1,900,242 A * 3/1933 Latou ..... E05B 75/00 70/16
5,660,064 A * 8/1997 Ecker ..... E05B 75/00 70/14
6,574,998 B2 * 6/2003 Kwon ..... E05B 75/00 70/16
8,210,006 B2 * 7/2012 Huang ..... E05B 75/00 70/16
9,551,170 B1 * 1/2017 Kovac ..... E05B 27/0003
10,180,019 B2 * 1/2019 Kovac ..... E05B 75/00
10,669,749 B2 * 6/2020 Kovac ..... E05B 75/00
2004/0237604 A1 * 12/2004 Kim ..... E05B 75/00 70/16
2012/0085135 A1 * 4/2012 Louden ..... E05B 75/00 70/16
2013/0192314 A1 * 8/2013 Cheng ..... E05B 75/00 70/16

* cited by examiner

*Primary Examiner* — Lloyd A Gall
(74) *Attorney, Agent, or Firm* — Dunlap Bennett & Ludwig, PLLC

(57) ABSTRACT

Handcuffs include an outer frame and at least one bow pivotally coupled to the outer frame. The at least one bow includes an arcuate shape and a plurality of ratchet teeth. At least a first locking bar and a second locking bar are pivotally coupled within the outer frame and each include a plurality of ratchet teeth and offset shoulders. At least one spring is disposed within the outer frame and includes a first portion biasing the plurality of ratchet teeth of the first locking bar to interlock with the plurality of ratchet teeth of the at least one bow and a second portion biasing the plurality of ratchet teeth of the second locking bar to interlock with the plurality of ratchet teeth of the at least one bow when the at least one bow is brought into cooperation with the first locking bar and the second locking bar.

7 Claims, 5 Drawing Sheets

MULTI-LOCK HANDCUFFS

CROSS-REFERENCE TO RELATED APPLICATION

This application claims the benefit of priority of U.S. provisional application No. 62/609,690, filed Dec. 22, 2017, the contents of which are herein incorporated by reference.

BACKGROUND OF THE INVENTION

The present invention relates to handcuffs and, more particularly, to an improved handcuff that is unable to be picked or shimmed using foreign objects.

Handcuffs are restraint devices designed to secure an individual's wrists close together. They comprise two parts, linked together by a chain, a hinge, or rigid bar. Each half has a rotating arm which engages with a ratchet that prevents it from being opened once closed around a person's wrist. Without the key, the handcuffs cannot be removed and so the handcuffed person is unable to move his or her wrists more than a few centimeters/inches apart, making many tasks difficult or impossible. An experienced lock picker may easily pick or shim the current handcuffs to unlock them.

As can be seen, there is a need for improved handcuffs that prevent individuals from picking or shimming the lock and freeing themselves from the handcuffs.

SUMMARY OF THE INVENTION

In one aspect of the present invention, a multi-lock handcuff assembly comprises: an outer frame; at least one bow pivotally coupled to the outer frame, and comprising an arcuate shape and a plurality of ratchet teeth; a first locking bar pivotally coupled within the outer frame and comprising a plurality of ratchet teeth and a first shoulder; a second locking bar pivotally coupled within the outer frame and comprising a plurality of ratchet teeth and a second shoulder offset from the first shoulder; and at least one spring disposed within the outer frame and comprising a first portion biasing the plurality of ratchet teeth of the first locking bar to interlock with the plurality of ratchet teeth of the at least one bow and a second portion biasing the plurality of ratchet teeth of the second locking bar to interlock with the plurality of ratchet teeth of the at least one bow when the at least one bow is brought into cooperation with the first locking bar and the second locking bar.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes handcuffs with a new and unique locking system. The locking system is not able to be picked or shimmed by foreign objects. Therefore, users that are locked in the handcuffs of the present invention are unable to shimmy or defeat the locking mechanism and escape. Further, the present invention utilizes strengthened swivels and chains.

Figure 1:
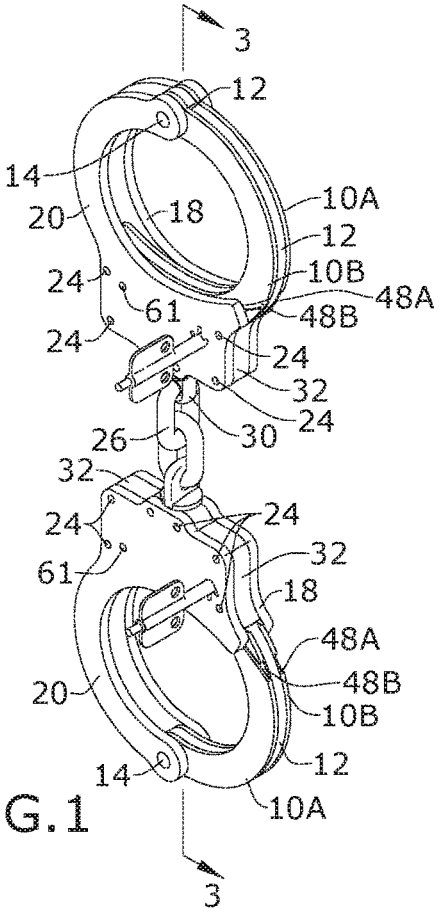
FIG. 1 is a perspective view of an embodiment of the present invention.
Figure 2:
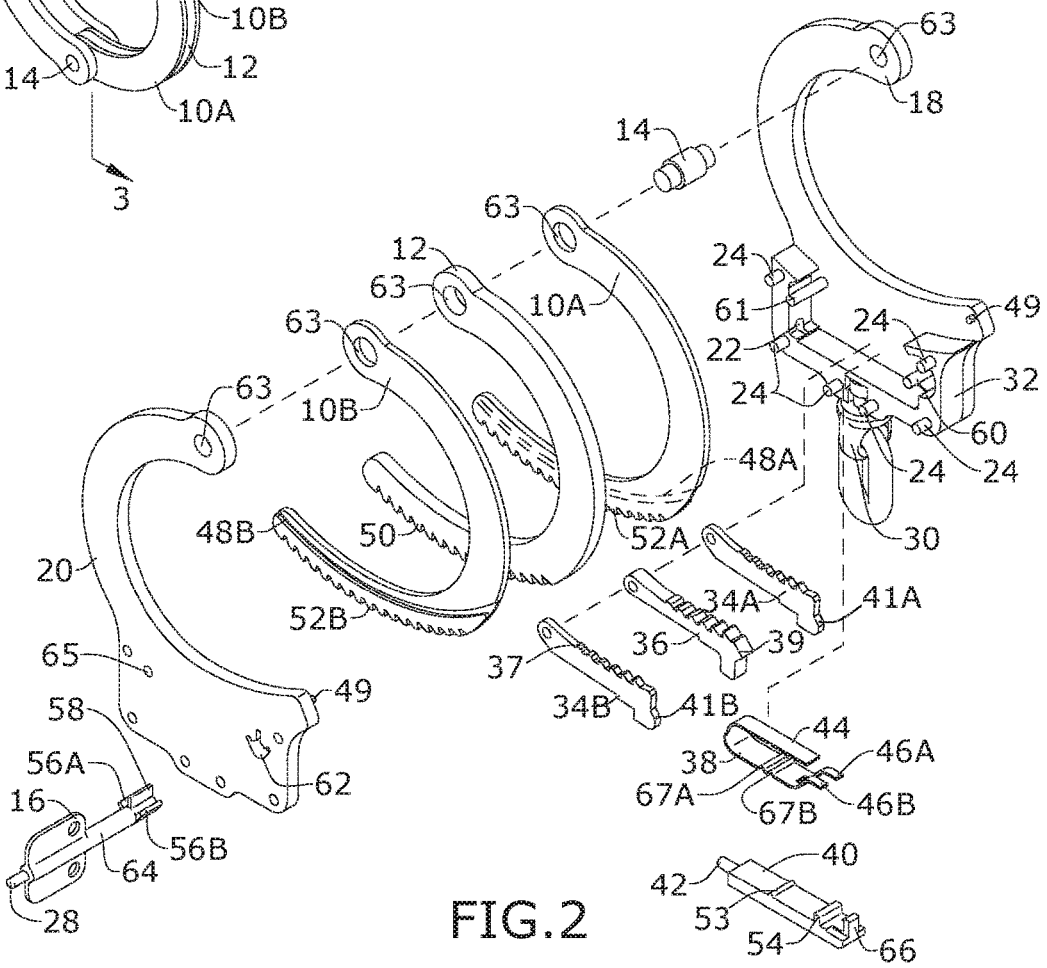
FIG. 2 is an exploded view of an embodiment of the present invention.
Figure 3:
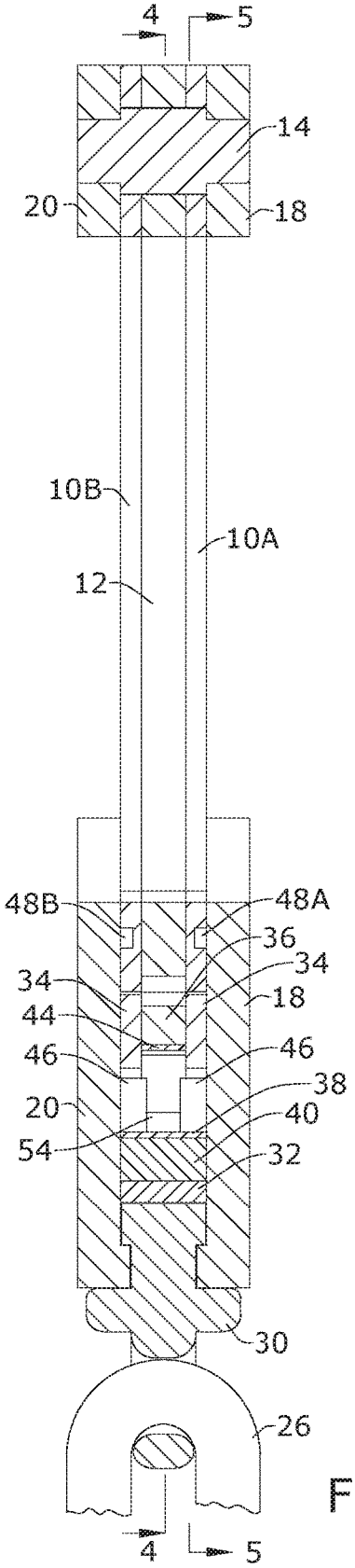
FIG. 3 is a section view of the present invention, taken along line 3-3 in FIG. 1.
Figure 4:
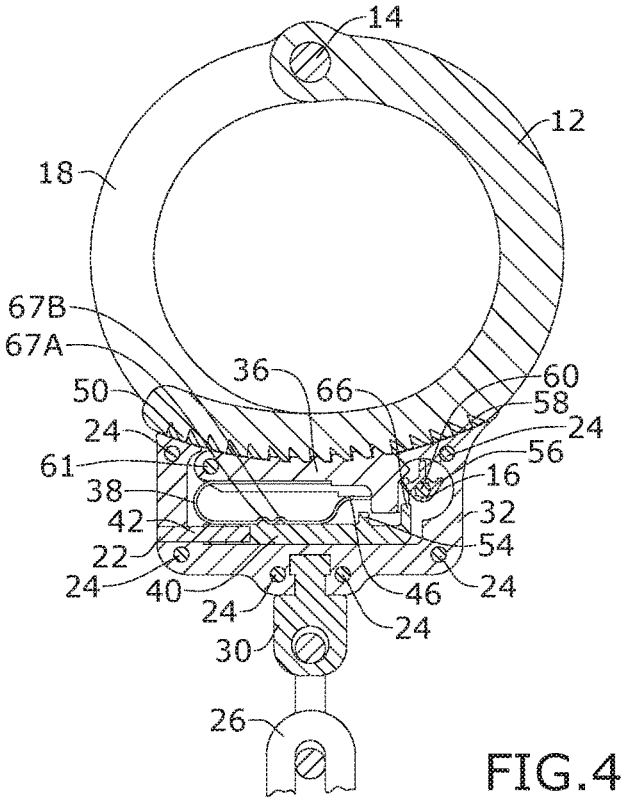
FIG. 4 is a section view of the present invention, taken along line 4-4 in FIG. 3.
Figure 5:
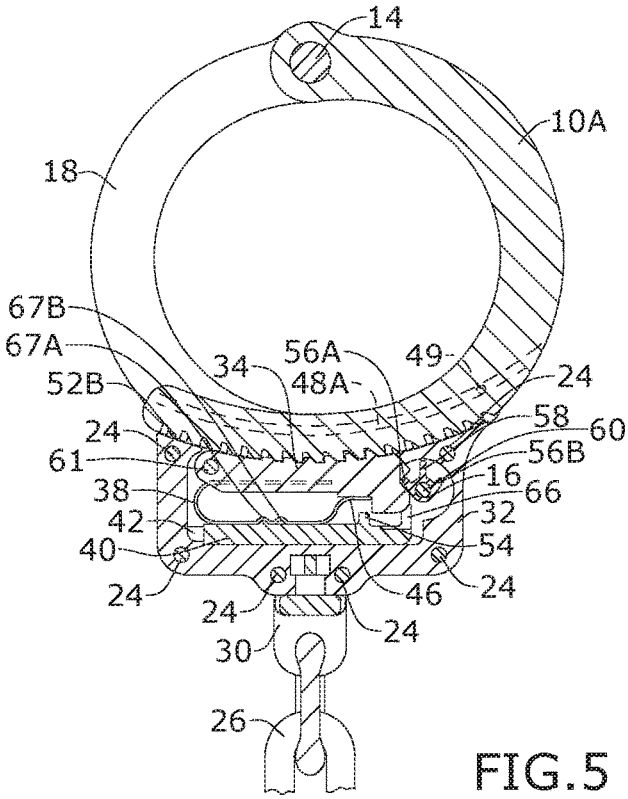
FIG. 5 is a section view of the present invention, taken along line 5-5 in FIG. 3.
Figure 6:
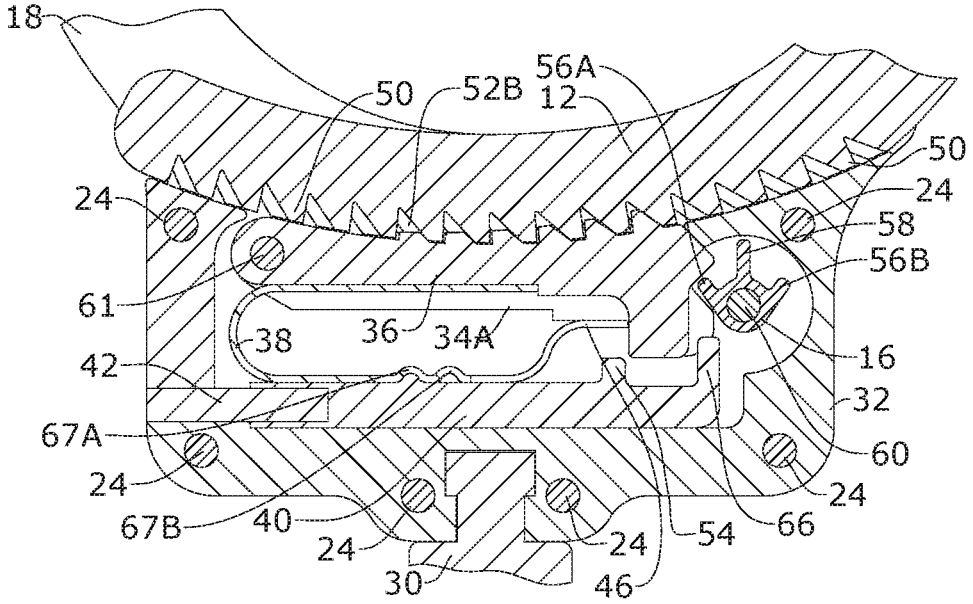
FIG. 6 is a detailed section view of the present invention of FIG. 4.
Figure 7:
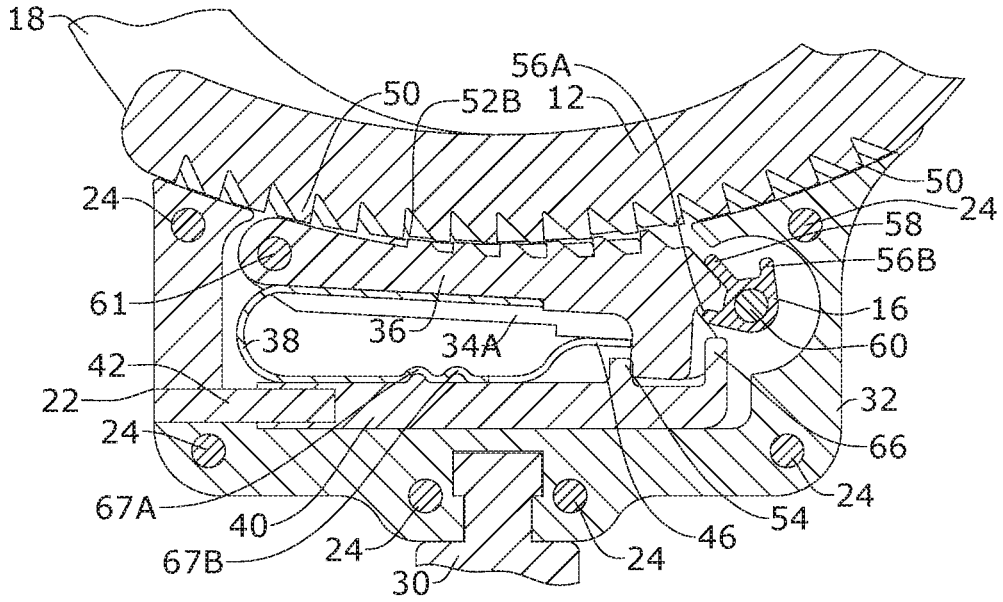
FIG. 7 is a detailed section view of the present invention of FIG. 4, in an unlocked position.
Figure 8:
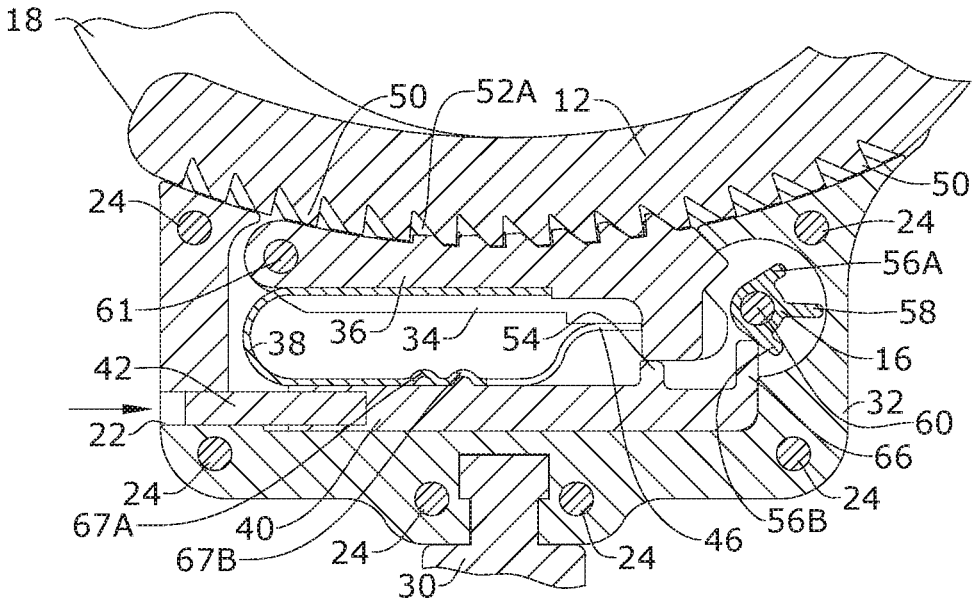
FIG. 8 is a detailed perspective view of an embodiment of the present invention, in a double locked position.
Figure 9:
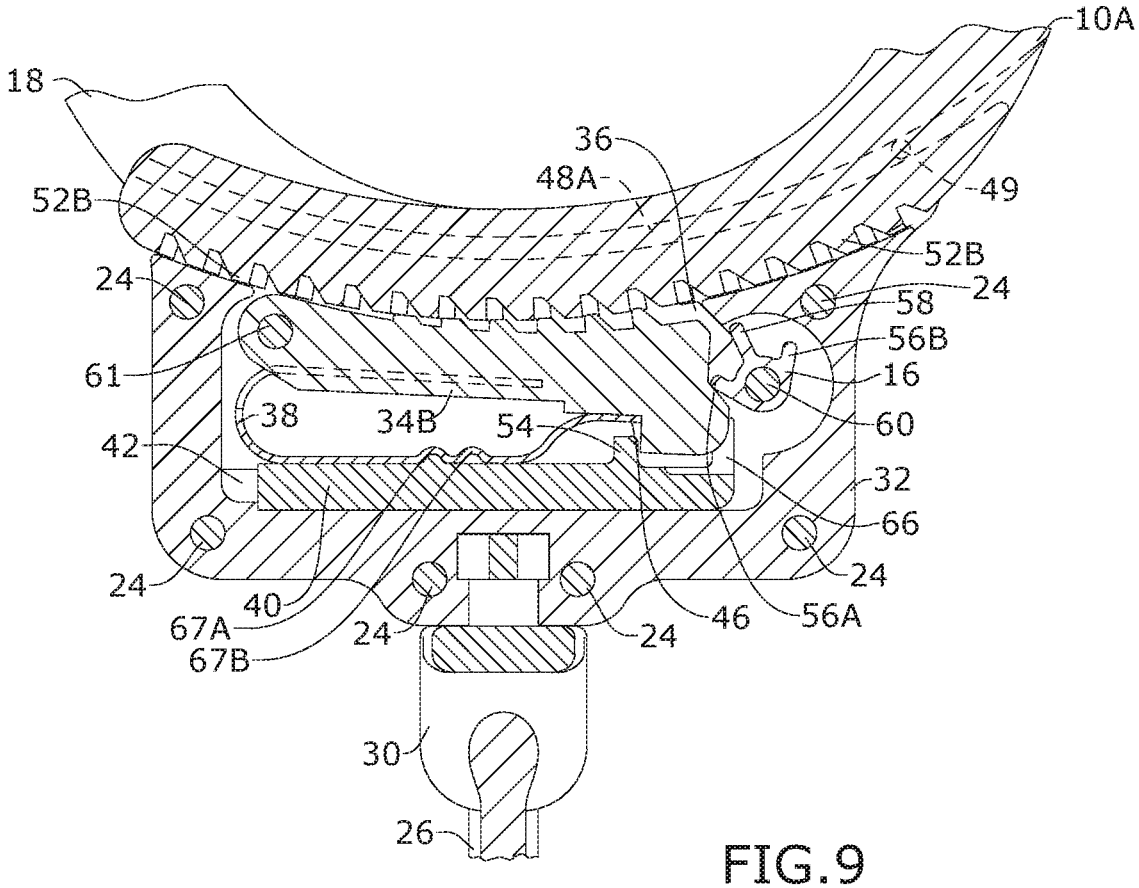
FIG. 9 is a detailed section view of the present invention of FIG. 5.
Figure 10:
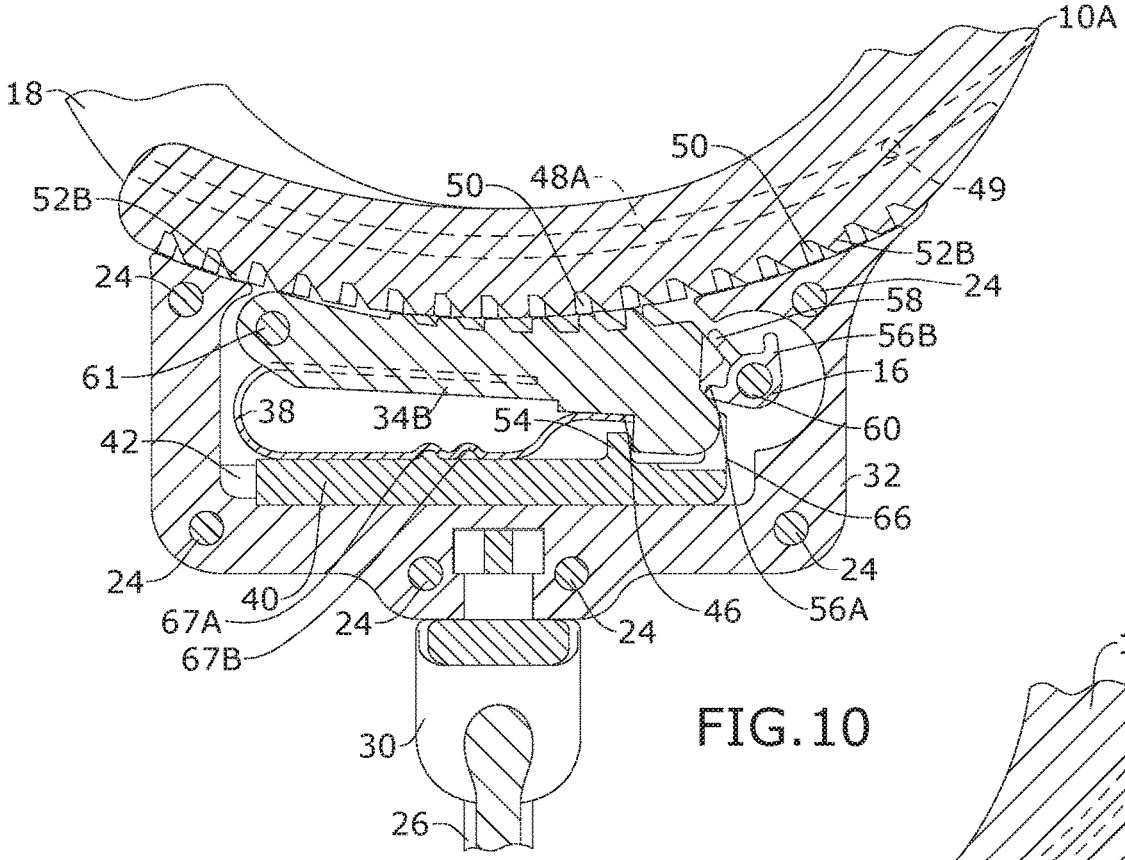
FIG. 10 is a detailed section view of the present invention of FIG. 5, transitioning from a locked position to an unlocked position.
Figure 11:
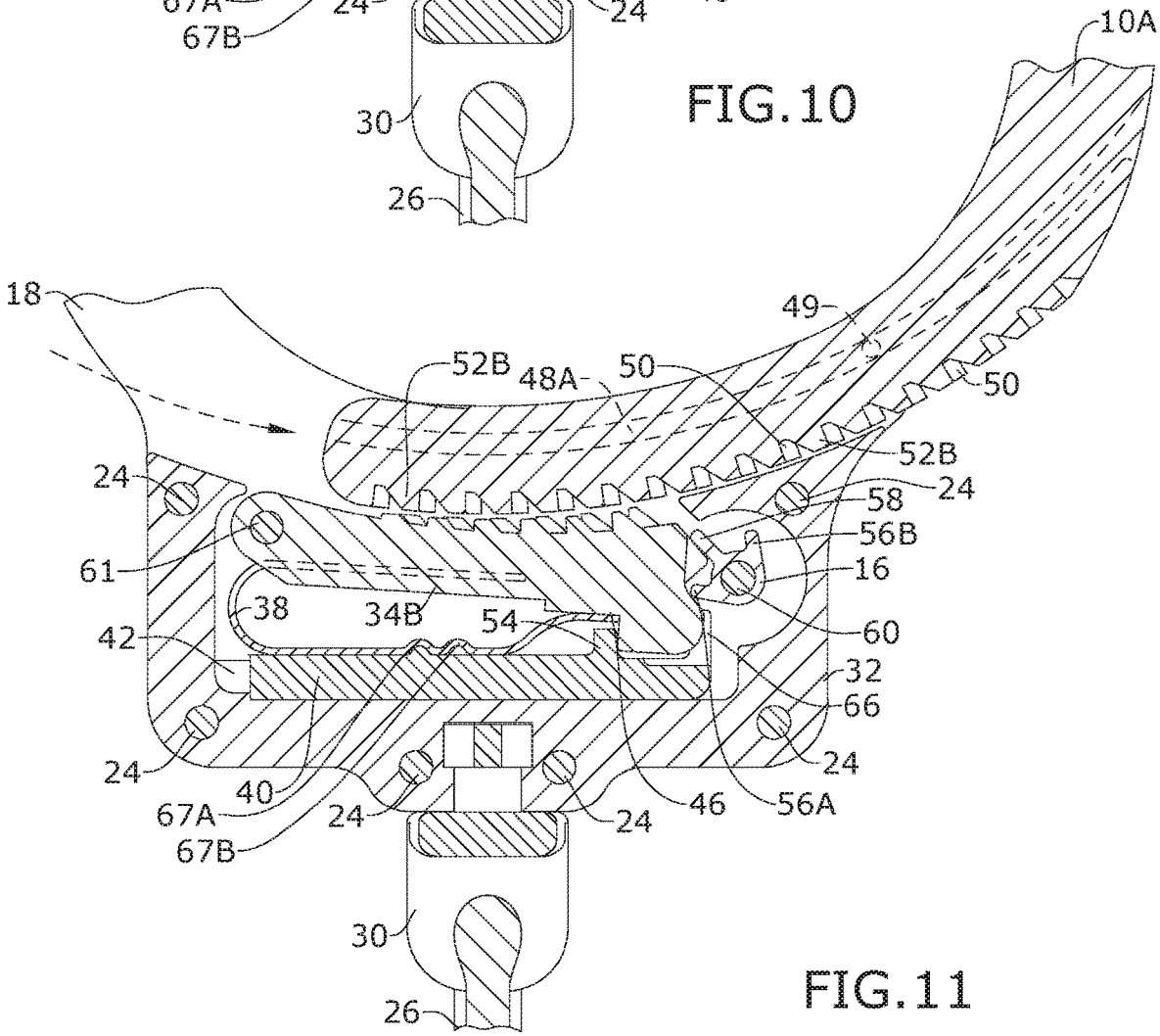
FIG. 11 is a detailed section view of the present invention of FIG. 5, in an unlocked position.

Referring to FIGS. 1 through 11, the present invention includes a multi-lock handcuff assembly. FIG. 1 illustrates a handcuff constructed in accordance with the present invention, it being appreciated that only one such handcuff normally comprising a pair thereof connected together by a chain 26 and swivels 30. Each of the pair include the components described below.

The handcuff of the present invention includes an outer frame 18, 20 and at least one bow 10A, 12, 10B pivotally coupled to the outer frame 18, 20. The at least one bow 10A, 12, 10B includes an arcuate shape and a plurality of ratchet teeth 52A, 50, 52B. The present invention further includes at least a first locking bar 34A and a second locking bar 36. The first locking bar 34A is pivotally coupled within the outer frame 18, 20 and includes a plurality of ratchet teeth 37 and a first shoulder 41A. The second locking bar 36 is pivotally coupled within the outer frame 18, 20 and includes a plurality of ratchet teeth 37 and a second shoulder 39 offset from the first shoulder 41A. At least one spring 38 is disposed within the outer frame 18, 20 and includes a first portion 46A biasing the plurality of ratchet teeth 37 of the first locking bar 34A to interlock with the plurality of ratchet teeth 52A, 50, 52B of the at least one bow 10A, 12, 10B and a second portion 44 biasing the plurality of ratchet teeth 37 of the second locking bar 36 to interlock with the plurality of ratchet teeth 52A, 50, 52B of the at least one bow 10A, 12, 10B when the at least one bow 10A, 12, 10B is brought into cooperation with the first locking bar 34A and the second locking bar 36.

The outer frame 18, 20 may include a first side 18 and a second side 20. Each of the first side 18 and the second side 20 include a base and an arcuate arm. The first side 18 and the second side 20 may be coupled together by frame rivets 24. The at least one bow 10A, 12, 10B may include a first outer bow 10A, a center bow 12, and a second outer bow 10B. The first outer bow 10A, the center bow 12, and the second outer bow 10B may be pivotally coupled to distal ends of the arcuate arms of the first side 18 and the second side 20 by a pivot pin 14 disposed within aligned openings 63.

The first outer bow 10A may include a plurality of ratchet teeth 52A, the center bow 12 may include a plurality of ratchet teeth 50, and the second outer bow 10B may include a plurality of ratchet teeth 52B. Further, the first outer bow 10A may include a first guide channel 48A and the second outer bow 10B may include a second guide channel 48B. Guide pins 49 of the first side 18 and the second side 20 guide the first and second outer bows 10A, 10B into a locked position within the outer frame 18, 20.

In certain embodiments, the present invention includes the first locking bar 34A, the second locking bar 36, and a third locking bar 34B. The third locking bar 34B also includes a plurality of ratchet teeth 37 and a third shoulder 41B offset from the second shoulder 39 and aligned with the first shoulder 41A. The first locking bar 34A, the second locking bar 36, and the third locking bar 34B are pivotally connected to a pivot pin 61 disposed within aligned openings 65 of the outer frame 18, 20. Each of the first locking bar 34A, the second locking bar 36, and the third locking bar 34B independently pivot relative to one another about the pivot pin 61. The second locking bar 36 is disposed in between the first locking bar 34A and the third locking bar 34B. In such embodiments, the first portion 46A of the at least one spring 38 biases the plurality of ratchet teeth 37 of the first locking bar 34A to interlock with the plurality of ratchet teeth 52A of the first bow 10A, the second portion 44 of the at least one spring 38 biases the plurality of ratchet teeth 37 of the second locking bar 36 to interlock with the plurality of ratchet teeth 50 of the second bow 12, and the third portion 46B of the at least one spring 38 biases the third locking bar 34B to interlock with the plurality of ratchet teeth 52B of the third bow 10B. The first portion 46A, the second portion 44, and the third portion 46B of the spring 38 bias each of the first locking bar 34A, the second locking bar 36, and the third locking bar 34B independent of one another.

The present invention may further include an inner frame 32 disposed in between the first side 18 and the second side 20 of the outer frame 18, 20. The spring 38 may be disposed within the inner frame 32. The spring 38 of the present invention includes a U-shaped strip of resilient material, such as a flexible metal or plastic. The spring 38 includes an upper leg and a lower leg. The upper leg is the second portion 44 of the spring, and a pair of tabs upward extending from the lower leg is the first portion 46A and the third portion 46B of the spring 38.

The present invention further includes a key 16. The key 16 includes a shaft 64 and a head. A first key flag 56A, a second key flag 58, and a third key flag 56B may protrude radially from the shaft 64 at the head. An opening may be defined at an end of the head. The outer frame 20 includes a keyway 62 defined to receive the key head. A key head guide pin 60 may be secured within the outer frame 18, 20. When inserting the key head, the opening of the key head fits over the key head guide pin 60 and the key head guide pin 60 guides the key 16 to the correct position within the inner frame 32. When rotating the key 16 within the keyway 62 in a first direction, the first key flag 56A engages the first shoulder 41A and the third shoulder 41B while the second key flag 58 engages the second shoulder 39. The key 16 thereby pushes the first locking bar 34A, the second locking bar 36, and the third locking bar 34B away from the first outer bow 10A, the center bow 12, and the second outer bow 10B respectively against the bias of the spring 38. The ratchet teeth disengage and the bows 10A, 12, 10B are free to pivot relative to the outer frame 18, 20.

The present invention may further include a double lock bar 40. The double lock bar 40 is slidably disposed within the inner frame 32 beneath the spring 38. The double lock bar 40 includes a bar stop 54 protruding from an upper surface. The double lock bar 40 is configured to slide laterally to a locked position in which the bar stop 54 prevents the first locking bar 34A, the second locking bar 36, and the third locking bar 34B from pivoting away from the bows 10A, 12, 10B. The double lock bar 40 may further include a ridge 53. The spring 38 includes a first dimple 67A and a second dimple 67B defined on a lower surface. The ridge 53 is disposed within the first dimple 67A in an unlocked position and the ridge 53 is disposed within the second dimple 67B in a locked position. The double lock bar further includes a pin 42 slidably disposed within a pin opening 22 of the inner frame 32. The key 64 may further include a lock bar pin 28 that fits within the pin opening 22. By pressing the lock bar pin 28 against the pin 42, the double lock bar 30 slides from the unlocked position to the locked position. The double lock bar 40 may further include an unlock tab 66. When rotating the key 16 within the keyway 62 in a second direction, the third key flag 56B of the key 16 engages the unlock tab 66 and urges the double lock bar 40 to slide from the locked position back to the unlocked position. The key 16 may then be rotated in the first direction, opposite the second direction, to unlock the handcuffs.

A method of using the present invention may include the following. The present invention includes a single lock mode and a double lock mode. To unlock the present invention in the single lock mode, the key 16 is inserted into the keyway 62 and is guided into position within the handcuff frame by way of the key head guide pin 60. The key head guide pin 60 allows the key 16 to properly align with the locking bars 34A, 36, 34B. As the key 16 is rotated in the first direction, the first key flag 56A comes in contact with both of the shoulders 41A, 41B of the first and third locking bars 34A, 34B. Concurrently, the second key flag 58 comes in contact with the shoulder 39 of the second locking bar 36. As pressure is applied by both the first and second key flags 56A, 58, simultaneously, all three locking bars 34A, 36, 34B (inner and outer) are moved down and away from their locking engagement with ratchet teeth 52A, 50, 52B of the bows 10A, 12, 10B. This action releases the bows 10A, 12, 10B from the locking bars 34A, 36, 34B. Once the bows 10A, 12, 10B disengage from the locking bars 34A, 36, 34B, the bows 10A, 12, 10B can swing freely through its rotation between the inside and outside handcuff outer frame 18, 20.

To engage the present invention in the double lock mode, the bows 10A, 12, 10B engage with the locking bars 34A, 36, 34B. Using the key 16, insert the lock bar pin 28 (located on the top of the key 16) into the pin opening 22 located on the outside edge of the inner frame 32. Applying pressure to the pin 42 pushes the double lock bar 40 from a disengaged position to an engaged position under the spring 38 and locking bars 34A, 36, 34B. The handcuffs are now in a double locked position. The spring 38 holds constant tension against the locking bars 34A, 36, 34B (in three individual and independent points of contact) and the double lock bar 40.

In order to disengage the double lock bar 40, the key 16 is inserted into the keyway 62 and is guided into position within the handcuff frame by way of a key head guide pin 60. The key head guide pin 60 aligns the third key flag 56B with the unlock tab 66 of the double lock bar 40. As the key 16 is rotated in the second direction, the third key flag 56B comes in contact with the unlock tab 66 of the double lock bar 40. Applying pressure to the unlock tab 66 urges the double lock bar 40 to disengage from its double lock position by moving the bar stop 54 out from under the locking bars 34A, 36, 34B and spring 38. Once the double lock bar 40 is disengaged, the key 16 can be rotated in the first direction for disengagement of the single lock mode (see above). Without simultaneous engagement of all three independent contact points (shoulders) of the locking bars 34A, 36, 34B, the locking bars 34A, 36, 34B do not disengage (unlock) from the bows 10A, 12, 10B.

It should be understood, of course, that the foregoing relates to exemplary embodiments of the invention and that modifications may be made without departing from the spirit and scope of the invention as set forth in the following claims.

What is claimed is:

1. A multi-lock handcuff assembly comprising:

an outer frame;

at least one bow pivotally coupled to the outer frame, and comprising an arcuate shape and a plurality of ratchet teeth;

a first locking bar pivotally coupled within the outer frame and comprising a plurality of ratchet teeth and a first shoulder;

a second locking bar pivotally coupled within the outer frame and comprising a plurality of ratchet teeth and a second shoulder offset from the first shoulder;

at least one spring disposed within the outer frame and comprising a first portion biasing the plurality of ratchet teeth of the first locking bar to interlock with the plurality of ratchet teeth of the at least one bow and a second portion biasing the plurality of ratchet teeth of the second locking bar to interlock with the plurality of ratchet teeth of the at least one bow when the at least one bow is brought into cooperation with the first locking bar and the second locking bar; and a third locking bar pivotally coupled within the outer frame and comprising a plurality of ratchet teeth and a third shoulder offset from the second shoulder and aligned with the first shoulder, wherein the first locking bar, the second locking bar, and the third locking bar are pivotally connected to a pivot pin within the outer frame and the second locking bar is disposed in between the first locking bar and the third locking bar, and wherein the at least one bow comprises a first bow, a second bow, and a third bow, wherein the first portion of the at least one spring biases the plurality of ratchet teeth of the first locking bar to interlock with the plurality of ratchet teeth of the first bow, the second portion of the at least one spring biases the plurality of ratchet teeth of the second locking bar to interlock with the plurality of ratchet teeth of the second bow, and a third portion of the at least one spring biases the third locking bar to interlock with the plurality of ratchet teeth of the third bow.

2. A multi-lock handcuff assembly comprising:

an outer frame;

at least one bow pivotally coupled to the outer frame, and comprising an arcuate shape and a plurality of ratchet teeth;

a first locking bar pivotally coupled within the outer frame and comprising a plurality of ratchet teeth and a first shoulder;

a second locking bar pivotally coupled within the outer frame and comprising a plurality of ratchet teeth and a second shoulder offset from the first shoulder;

at least one spring disposed within the outer frame and comprising a first portion biasing the plurality of ratchet teeth of the first locking bar to interlock with the plurality of ratchet teeth of the at least one bow and a second portion biasing the plurality of ratchet teeth of the second locking bar to interlock with the plurality of ratchet teeth of the at least one bow when the at least one bow is brought into cooperation with the first locking bar and the second locking bar; and a third locking bar pivotally coupled within the outer frame and comprising a plurality of ratchet teeth and a third shoulder offset from the second shoulder and aligned with the first shoulder, wherein the first locking bar, the second locking bar, and the third locking bar are pivotally connected to a pivot pin within the outer frame and the second locking bar is disposed in between the first locking bar and the third locking bar, wherein the at least one spring comprises a U-shaped strip of resilient material comprising an upper leg and a lower leg, wherein the upper leg is the second portion of the at least one spring, and a pair of tabs upward extending from the lower leg is the first portion and a third portion of the at least one spring.

3. The multi-lock handcuff assembly of claim 2, further comprising a key comprising a shaft and a key head, wherein a first key flag and a second key flag radially extend from the key head, wherein the outer frame comprises a keyway defined to receive the key head, wherein when rotating the key within the keyway in a first direction, the first key flag engages the first shoulder and the second key flag engages the second shoulder, pushing the first locking bar and the second locking bar away from the at least one bow against the bias of the at least one spring.

4. The multi-lock handcuff assembly of claim 3, further comprising a double lock bar comprising a bar stop protruding from an upper surface, wherein the double lock bar is slidably disposed within the outer frame and beneath the at least one spring, wherein the double lock bar is configured to slide laterally to a locked position in which the bar stop prevents the first locking bar and the second locking bar from pivoting away from the at least one bow.

5. The multi-lock handcuff assembly of claim 4, wherein the double lock bar comprises a ridge, and the at least one spring comprises a first dimple and a second dimple defined on a lower surface, wherein the ridge is disposed within the first dimple in an unlocked position and the ridge is disposed within the second dimple in a locked position.

6. The multi-lock handcuff assembly of claim 5, wherein the double lock bar further comprises a pin slidably disposed within a pin opening of the outer frame, wherein applying pressure against the pin urges the double lock bar to slide from the unlocked position to the locked position.

7. The multi-lock handcuff assembly of claim 6, wherein the double lock bar further comprises an unlock tab, wherein when rotating the key within the keyway in a second direction, a third key flag of the key engages the unlock tab and urges the double lock bar to slide from the locked position to the unlocked position.

* * * * *